US005234867A

United States Patent [19]

Schultz et al.

[11] Patent Number: 5,234,867

[45] Date of Patent: Aug. 10, 1993

[54] METHOD FOR PLANARIZING SEMICONDUCTOR WAFERS WITH A NON-CIRCULAR POLISHING PAD

[75] Inventors: Laurence D. Schultz; Mark E. Tuttle; Trung T. Doan, all of Boise, Id.

[73] Assignee: Micron Technology, Inc., Boise, Id.

[21] Appl. No.: 889,521

[22] Filed: May 27, 1992

[51] Int. Cl.[5] ..... H01L 21/302; H01L 21/463

[52] U.S. Cl. ..... 437/225; 437/946; 437/974; 156/636; 156/637

[58] Field of Search ..... 437/225, 8, 946, 974; 148/17; 51/131.4, 131.3, 131.5; 156/345, 636, 637

[56] References Cited

U.S. PATENT DOCUMENTS

| | | | |
|---|---|---|---|
| 3,841,031 | 7/1974 | Walsh | 51/131 |
| 4,193,226 | 1/1980 | Gill, Jr. et al. | 51/124 R |
| 4,239,567 | 12/1980 | Winings | 51/216 LP |
| 4,437,269 | 3/1984 | Shaw | 51/358 |
| 4,511,605 | 4/1985 | McCartney | 427/246 |
| 4,811,522 | 6/1989 | Gill, Jr. | 51/131.1 |
| 4,927,432 | 5/1990 | Budinger et al. | 51/298 |
| 4,934,102 | 6/1990 | Leach et al. | 51/50 R |
| 5,036,015 | 7/1991 | Sandhu et al. | 437/8 |
| 5,081,796 | 11/1992 | Schultz | 51/165.74 |
| 5,104,828 | 4/1992 | Morimoto et al. | 437/225 |

*Primary Examiner*—Olik Chaudhuri
*Assistant Examiner*—H. Jey Tsai
*Attorney, Agent, or Firm*—Wells, St. John, Roberts, Gregory & Matkin

[57] ABSTRACT

An apparatus for planarizing semiconductor wafers in its preferred form includes a rotatable platen for polishing a surface of the semiconductor wafer and a motor for rotating the platen. A non-circular pad is mounted atop the platen to engage and polish the surface of the semiconductor wafer. A polishing head holds the surface of the semiconductor wafer in juxtaposition relative to the non-circular pad. A polishing head displacement mechanism moves the polishing head and semiconductor wafer across and past a peripheral edge of the non-circular pad to effectuate a uniform polish of the semiconductor wafer surface. Also disclosed is a method for planarizing a semiconductor surface using a non-circular polishing pad.

4 Claims, 4 Drawing Sheets

METHOD FOR PLANARIZING SEMICONDUCTOR WAFERS WITH A NON-CIRCULAR POLISHING PAD

TECHNICAL FIELD

This invention relates to apparatus for planarizing semiconductor wafers and more particularly, to chemical mechanical planarization (CMP) apparatus. This invention also relates to polishing pads for use in a planarization apparatus. The invention further relates to processes for planarizing semiconductor wafers.

BACKGROUND OF THE INVENTION

In the fabrication of integrated circuits, numerous integrated circuits are typically constructed simultaneously on a single semiconductor wafer. The wafer is then later subjected to a singulation process in which individual integrated circuits are singulated from the wafer. At certain stages of fabrication, it is often necessary to polish a surface of the semiconductor wafer. In general, a semiconductor wafer can be polished to remove high topography, surface defects such as crystal lattice damage, scratches, roughness, or embedded particles of dirt or dust. This polishing process is often referred to as mechanical planarization and is utilized to improve the quality and reliability of semiconductor devices. This process is usually performed during the formation of various devices and integrated circuits on the wafer.

The polishing process may also involve the introductiion of a chemical slurry to facilitate higher removal rates and selectivity between films of the semiconductor surface. This polishing process is often referred to as chemical mechanical planarization (CMP).

In general, the CMP process involves holding and rotating a thin flat wafer of semiconductor material against a wetted polishing surface under controlled pressure and temperature. FIG. 1 shows a conventional CMP device 10 having a rotatable polishing platen 12, a polishing head assembly 14, and a chemical supply system 16. Platen 12 is rotated at a preselected velocity by motor 18. Platen 12 is typically covered with a replaceable, relatively soft material 20 such as blown polyurethane, which may be wetted with a lubricant such as water.

Polishing head assembly 14 includes a polishing head (not shown) which holds semiconductor wafer 22 adjacent to platen 12. Polishing head assembly 14 further includes motor 24 for rotating the polishing head and semiconductor wafer 22, and a polishing head displacement mechanism 26 which moves semiconductor wafer 22 across platen 12 as indicated by arrows 28 and 30. Polishing head assembly 14 applies a controlled downward pressure, P, as illustrated by arrow 32 to semiconductor wafer 22 to hold semiconductor wafer 22 against rotating platen 12.

Chemical supply system 16 introduces a polishing slurry (as indicated by arrow 34) to be used as an abrasive medium between platen 12 and semiconductor 22. Chemical supply system 16 includes a chemical storage 36 and a conduit 38 for transferring the slurry from chemical storage 36 to the planarization environment atop platen 12.

Another apparatus for polishing thin flat semiconductor wafers is discussed in our U.S. Pat. No. 5,081,796. Other apparatuses are described in U.S. Pat. Nos. 4,193,226 and 4,811,522 to Gill, Jr. and U.S. Pat. No. 3,841,031 to Walsh.

One problem encountered in CMP processes is the non-uniform removal of the semiconductor surface. Removal rate is directly proportional to downward pressure on the wafer, rotational speeds of the platen and wafer, slurry particle density and size, slurry composition, and the effective area of contact between the polishing pad and the wafer surface. Removal caused by the polishing platen is related to the radial position on the platen. The removal rate is increased as the semiconductor wafer is moved radially outward relative to the polishing platen due to higher platen rotational velocity. Additionally, removal rates tend to be higher at wafer edge than at wafer center because the wafer edge is rotating at a higher speed than the wafer center.

Another problem in conventional CMP processes is the difficulty in removing non-uniform films or layers which have been applied to the semiconductor wafer. During the fabrication of integrated circuits, a particular layer or film may have been deposited or grown in a desired uneven manner resulting in a non-uniform surface which is subsequently subjected to polishing processes. The thicknesses of such layers or films can be very small (on the order of 0.5 to 5.0 microns), thereby allowing little tolerance for non-uniform removal. A similar problem arises when attempting to polish warped surfaces on the semiconductor wafer. Warpage can occur as wafers are subjected to various thermal cycles during the fabrication of integrated circuits. As a result of this warpage, the semiconductor surface has high and low areas, whereby the high areas will be polished to a greater extent than the low areas. These and other problems plague conventional CMP processes.

The present invention provides a planarization process which significantly reduces the problems associated with non-uniform removal across the platen and uneven or warped surfaces of the semiconductor wafer.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with an aspect of the invention, an apparatus for planarizing semiconductor wafers comprises:

a rotatable platen for polishing a surface of a semiconductor wafer of selected diameter;

drive means for rotating the platen in a selected rotational direction;

a non-circular pad mounted on the platen; and a polishing head for holding the surface of the semiconductor wafer in juxtaposition relative to the non-circular pad.

The non-circular pad has peripheral projected portions and peripheral recessed portions. Preferably, the projected and recessed portions have a radial distance therebetween which is less than the wafer selected diameter.

In accordance with another aspect of the invention, an apparatus for planarizing semiconductor wafers comprises:

a rotatable platen for polishing a surface of a semiconductor wafer of selected diameter;

first drive means for rotating the platen in a selected rotational direction;

a non-circular pad mounted on the platen, the non-circular pad having a non-circular peripheral edge;

a polishing head for holding the surface of the semiconductor wafer in juxtaposition relative to the non-circular pad;

second drive means for rotating the polishing head and wafer in a selected rotational direction; and polishing head displacement means for moving the wafer under a controlled pressure across the non-circular pad and to a location beyond the peripheral edge of the non-circular pad.

In accordance with yet another aspect of the invention, a process for planarizing semiconductor wafers comprises the steps of:

rotating a non-circular pad having a non-circular peripheral edge;

holding a surface of a semiconductor wafer in juxtaposition relative to the non-circular pad; and rotating the wafer and moving the water across the non-circular pad.

Figure 1:
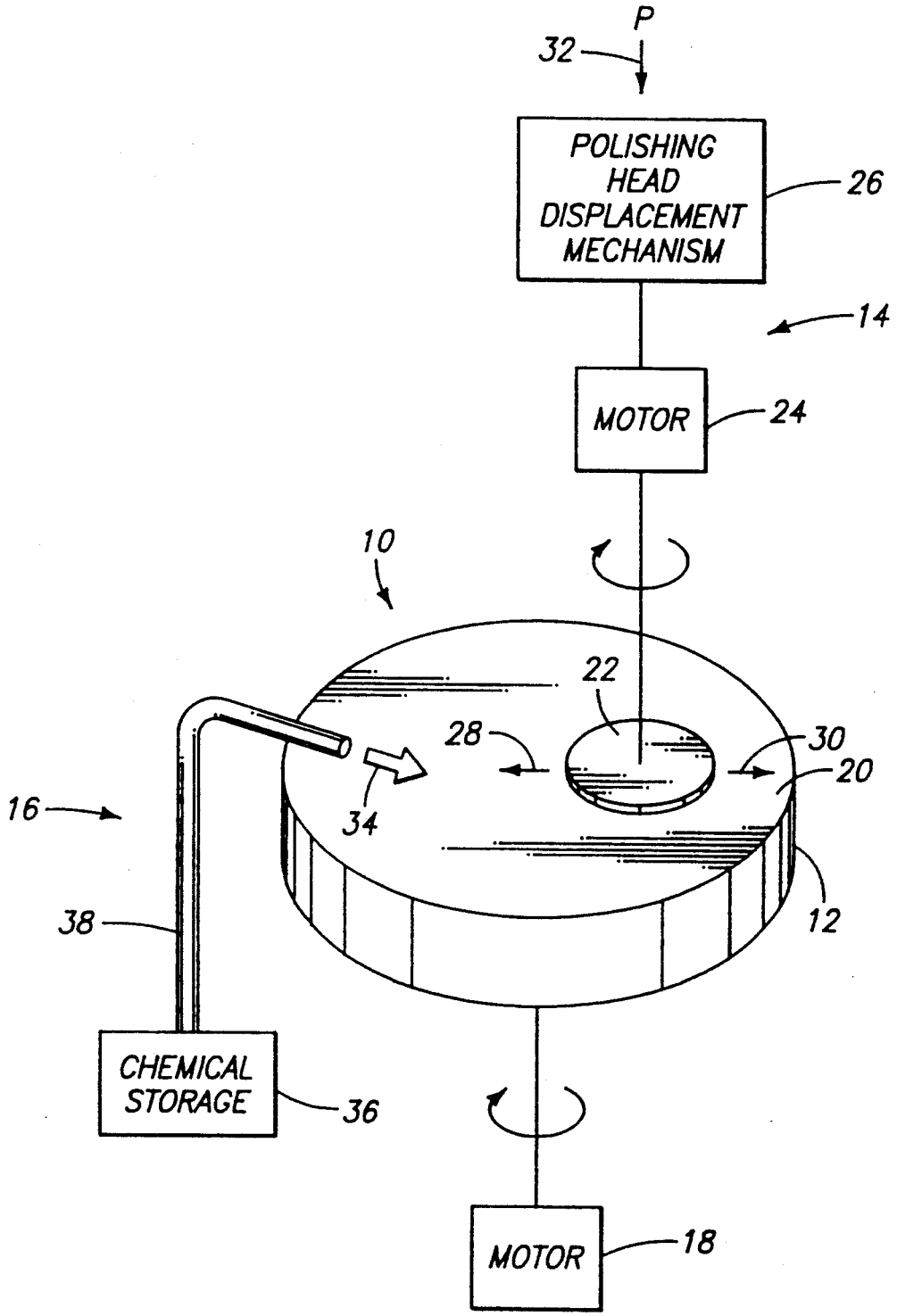
FIG 1 PRIOR ART
FIG. 1 is a diagrammatic perspective view of a conventional, prior art, CMP device.
Figure 2:
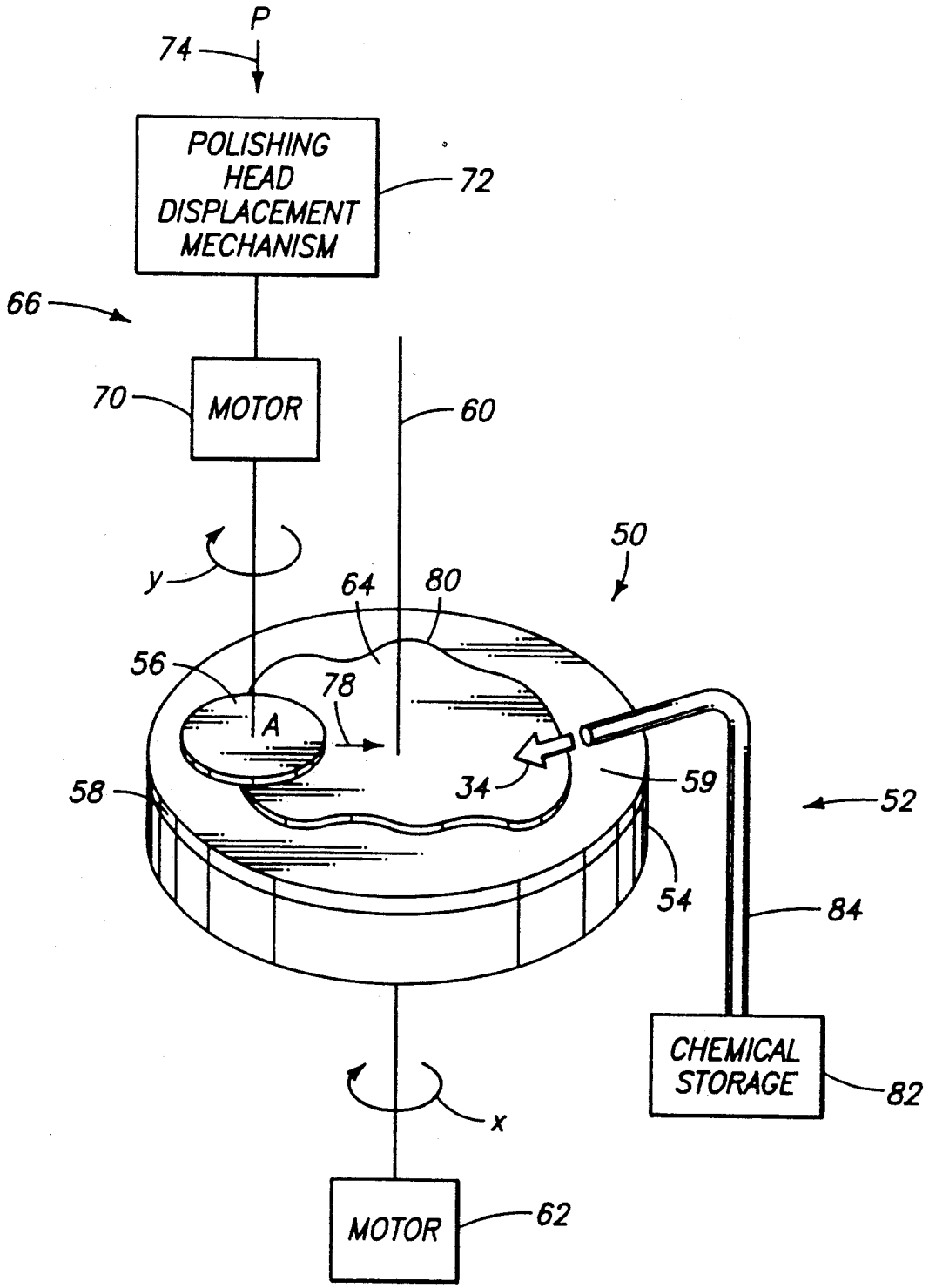
FIG. 2 is a diagrammatic perspective view of a CMP device according to the invention.
Figure 3:
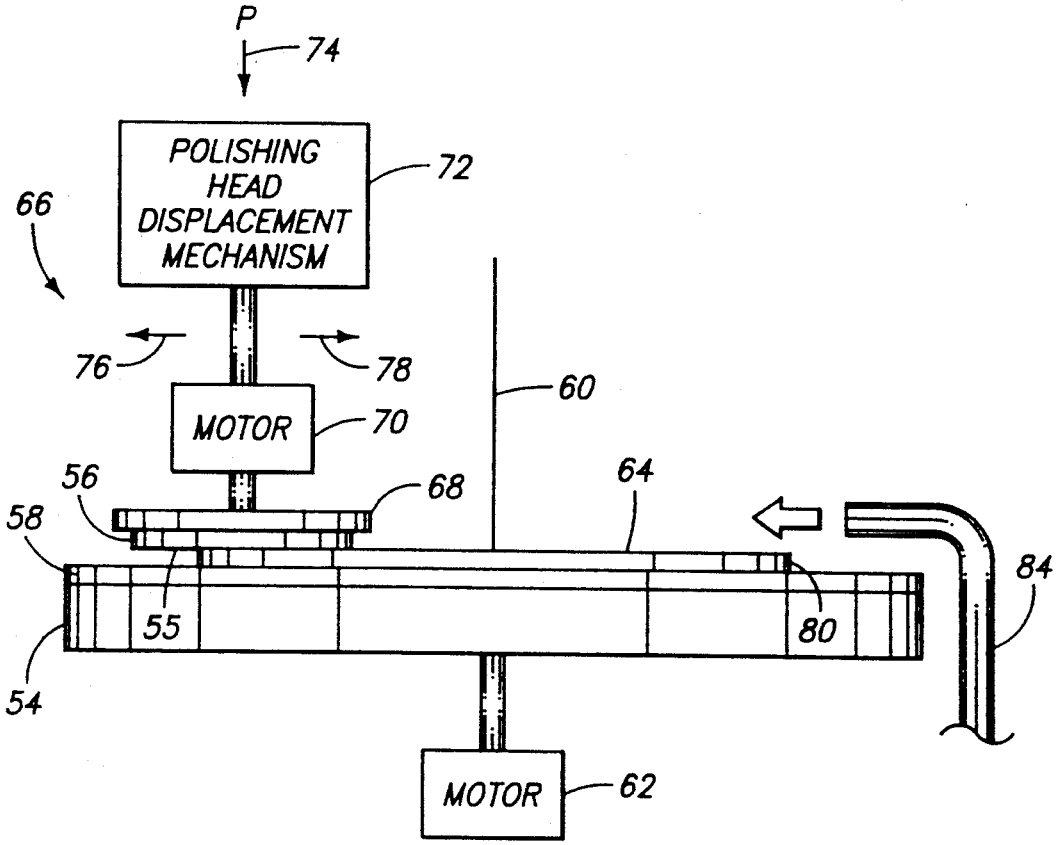
FIG. 3 is a diagrammatic side view of the CMP device according to the invention.

FIGS. 2 and 3 are diagrammatical illustrations of a mechanical planarization device 50 for planarizing semiconductor wafers. In its preferred form, mechanical planarization device 50 includes a chemical supply system 52 for introducing a chemical slurry to facilitate the polishing of a semiconductor wafer. Accordingly, in its preferred form, planarization device 50 is a chemical mechanical planarization apparatus.

Planarization device 50 includes a rotatable platen 54 for polishing a surface 55 (FIG. 3) of semiconductor wafer 56. Platen 54 is rotated about a center axis 60 by motor or other drive means 62 in a selected direction x. Platen 54 is circular having a circular periphery (which is referenced generally by numeral 59) and has a circular first pad 58 mounted thereon. First pad 58 protects platen 54 from the chemical slurry introduced during the polishing process, and is typically made of blown polyurethane. First pad 58 has a circular periphery (which is also referenced generally by numeral 59) which extends to the periphery of platen 54 as shown.

A second, non-circular pad 64 having a non-peripheral edge 80 is mounted atop first pad 58. The combination of first and second pads 58, 64 provides a desired, slightly resilient surface. If first pad 58 is omitted, non-circular pad 64 would be mounted directly on platen 54. Non-circular pad 64 is mounted substantially within periphery 59 of first pad 58 and platen 54. Non-circular pad 64 may be tailored to effectuate desired uniform polishing of semiconductor wafer 56. Non-circular pad 64 will be described in more detail below with reference to FIGS. 4 and 5.

Planarization device 50 includes polishing head assembly 66 which consists of polishing head 68 (FIG. 3), motor 70, and polishing head displacement mechanism 72. Polishing head 68 holds surface 55 of semiconductor wafer 56 in juxtaposition relative to non-circular pad 64. Preferably, polishing head assembly 66 applies a controlled downward pressure P (as illustrated by arrow 74) such that surface 55 of semiconductor wafer 56 contacts non-circular pad 64 in a manner which most effectively and controllably facilitates polishing of surface 55. Motor 70, or other drive means, rotates polishing head 68 and wafer 56 in a selected rotational direction y which is the same rotational direction that platen 54 is rotated by motor 62.

Polishing head displacement mechanism 72 moves wafer 56 under controlled pressure P across non-circular pad 64 as indicated by arrows 76 and 78. Polishing head displacement mechanism 72 is also capable of moving semiconductor wafer 56 to a location beyond non-circular peripheral edge 80 of non-circular pad 64 so that wafer 56 "overhangs" edge 80. This overhang arrangement permits wafer 56 to be moved partially on and partially off non-circular pad 64 to compensate for polishing irregularities caused by relative velocity differential between the faster moving outer portions and the slower moving inner portions of non-circular pad 64.

Chemical supply system 52 includes a chemical storage 82 for storing slurry and a conduit 84 for transferring the slurry from chemical storage 82 to the planarization environment atop platen 54. Chemical supply system 52 introduces slurry as indicated by arrow 86 atop non-circular pad 64. This chemical slurry provides an abrasive material which facilitates polishing of wafer surface 55, and is preferably formed of a solution including solid alumina or silica.

In operation, platen 54 and non-circular pad 64 are rotated at a preselected velocity. Wafer 56 is rotated in the same direction that platen 54 is being rotated. Surface 55 of semiconductor 56 is then held in juxtaposition relative to non-circular pad 64 so that pad 64 can polish surface 55. Rotating semiconductor wafer 56 is then moved back and forth across non-circular pad 64 under controlled pressure P and to a location beyond non-circular peripheral edge 80 of non-circular pad 64 to facilitate a uniform polish of surface 55.

Figure 4:
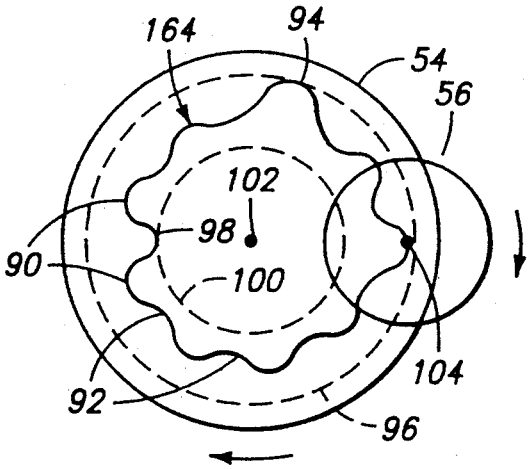
FIGS. 4–6 are diagrammatic top plan views showing positioning of a semiconductor wafer relative to a polishing platen and different designs of polishing pads constructed in accordance with the invention.
Figure 5:
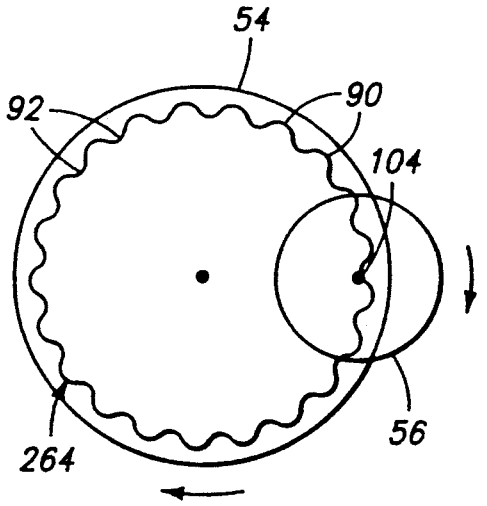
Figure 6:
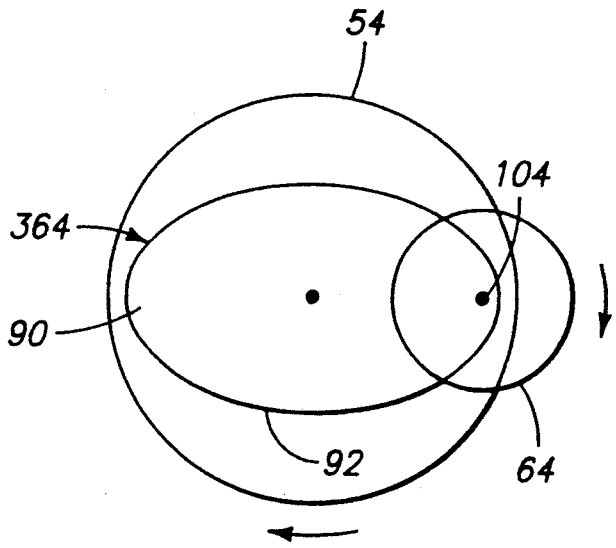

FIGS. 4–6 illustrate the movement of wafer 56 relative to platen 54 and non-circular pads 164 (FIG. 4), 264 (FIG. 5), and 364 (FIG. 6). Pads 164, 264, and 364 are of different example non-circular designs. Pads 164, 264, and 364 have peripheral projected portions 90 and peripheral recessed portions 92. The radial difference between projected portions 90 and recessed portions 92 is less than the diameter of semiconductor wafer 56. This feature is illustrated most clearly with reference to FIG. 4.

One of projected portions 90 has an outermost peripheral edge 94 of which is tangential to a circle 96. Circle 96 completely encircles and therefore defines an outermost boundary of non-circular pad 164. One of recessed portions 92 has an innermost peripheral edge 98 which is tangential to a circle 100. Circle 100 defines an inner most boundary of non-circular pad 164. Circles 96 and 100 are preferably concentric about a center point 102 which lies along center axis 60. The radial distance between circles 100 and 96 is preferably less than the diameter of semiconductor wafer 56.

During the planarization process, semiconductor wafer 56 is rotated about its wafer center 104. Polishing head displacement mechanism 72 preferably maintains wafer center 104 of semiconductor wafer 56 within the circumscribed boundary defined by circle 96. Maintaining the wafer center within this outer most boundary has been found to enhance the "uniformness" of the resulting polished wafer surface 55. Specifically, it is most preferred to overhang slightly less than one half of the semiconductor wafer. In this manner, wafer center 104 spends almost twice as much time in contact with non-circular pad 164 (or pads 264 or 364) as the wafer edge. By varying the position of the wafer relative to the pad edge, the ratio of center removal to edge removal approaches a uniform "1". That is, the removal rate at wafer center is approximately equal to the removal rate at wafer edge.

A non-circular pad according to this invention can be tailored to remove film from the semiconductor wafer in a more discriminatory way. Rate of removal R is defined by the following proportionality:

$$R \alpha k V(2\pi r)$$

where k represents the removal constant which is a function of pressure, slurry, and pad type; V represents the rotational speed of the pad/platen; and r represents the radial position on the pad. With this knowledge, the non-circular pad may be tailored to remove more wafer surface (including film, layers, foreign particles) in one area and less surface in others. This is a significant advantage over conventional planarization processes because the non-circular pad can achieve a more uniform planarization of non-uniform or warped semiconductor wafer surfaces.

The advantage of a non-circular pad may be better understood by way of example with reference to FIG. 5. Non-circular pad 264 has a non-circular "serpentining" edge of projected portions 90 and recessed portions 92. In contrast to a circular "non-serpentining" edge of prior art pads, non-circular pad 264 may be designed with deeper recessed portions to decrease the effective polishing surface area of the pad. A decreased surface area at the periphery of the pad assists in controlling the uniformity of the wafer polishing.

According to another aspect of the invention, a non-circular pad in combination with the overhang polishing technique (i.e., moving the wafer beyond the edge of the pad) provides a discriminatory, yet very uniform, polish which is significantly improved over prior art planarization devices.

In compliance with the statute, the invention has been described in language more or less specific as to structural and methodical features. It is to be understood, however, that the invention is not limited to the specific features described or shown, since the means herein disclosed comprise preferred forms of putting the invention into effect. The invention is, therefore, claimed in any of its forms of modifications within the proper scope of the appended claims appropriately interpreted in accordance with the doctrine of equivalents.

We claim:

1. A process for planarizing semiconductor wafers comprising the steps of:

rotating a non-circular pad having a non-circular peripheral edge;

holding a surface of a semiconductor wafer in juxtaposition relative to the non-circular pad;

rotating the wafer and moving the wafer across the non-circular pad; and moving at least a portion of the wafer to a location beyond the peripheral edge of the non-circular pad.

2. A process for planarizing semiconductor wafers comprising the steps of:

rotating a platen about a center axis, the platen having a non-circular pad mounted thereon, the non-circular pad having a non-circular peripheral edge;

holding a surface of a semiconductor wafer in juxtaposition relative to the non-circular pad;

rotating the wafer about a wafer center and moving the wafer across the non-circular pad; and maintaining the wafer center within a circumscribed boundary around the non-circular pad, the boundary being defined by a circle about the center axis and tangential to an outermost portion of the non-circular peripheral edge of the non-circular pad.

3. A process for planarizing semiconductor wafers comprising the steps of:

rotating a platen at a preselected velocity about a center axis, the platen having a non-circular pad mounted thereon, the non-circular pad having a non-circular peripheral edge;

rotating a semiconductor wafer about a wafer center in the same direction that the platen is rotating;

holding a surface of the semiconductor wafer in juxtaposition relative to the non-circular pad to polish the surface of the semiconductor wafer;

moving the wafer across the non-circular pad; and moving at least a portion of the wafer to a location beyond the peripheral edge of the non-circular pad to facilitate a uniform polish of the surface of the semiconductor wafer.

4. A process according to claim 3 further comprising maintaining the wafer center within a circumscribed boundary around the non-circular pad, the boundary being defined by a circle about the center axis and tangential to an outermost portion of the non-circular peripheral edge of the non-circular pad.

* * * * *

UNITED STATES PATENT AND TRADEMARK OFFICE

CERTIFICATE OF CORRECTION

PATENT NO. : 5,234,867
DATED : August 10, 1993
INVENTOR(S) : Schultz et al.

It is certified that error appears in the above-identified patent and that said Letters Patent is hereby corrected as shown below:

Column 1,
Line 5, add the following:

-- GOVERNMENT RIGHTS

This invention was made with the United States Government support under contract No.: DABT63-93-C-0025 awarded by the Advanced Research Projects Agency (ARPA). The United States Government has certain rights in this invention. --

Signed and Sealed this

Nineteenth Day of March, 2002

*Attest:*

*Attesting Officer*

JAMES E. ROGAN
*Director of the United States Patent and Trademark Office*